US008074840B2

(12) United States Patent
Pennaneac'h

(10) Patent No.: US 8,074,840 B2
(45) Date of Patent: Dec. 13, 2011

(54) FLUID DISPENSER ASSEMBLY

(75) Inventor: Herve Pennaneac'h, Piseux (FR)

(73) Assignee: Valois SAS, Le Neubourg (FR)

( * ) Notice: Subject to any disclaimer, the term of this patent is extended or adjusted under 35 U.S.C. 154(b) by 879 days.

(21) Appl. No.: 11/972,285

(22) Filed: Jan. 10, 2008

(65) Prior Publication Data

US 2008/0173671 A1 Jul. 24, 2008

Related U.S. Application Data

(60) Provisional application No. 60/907,062, filed on Mar. 19, 2007.

(30) Foreign Application Priority Data

Jan. 10, 2007 (FR) ..... 07 52603

(51) Int. Cl.
*B65D 35/28* (2006.01)
*B65D 35/56* (2006.01)

(52) U.S. Cl. ..... 222/103; 222/105; 222/546; 206/484

(58) Field of Classification Search ..... 222/95, 222/103, 105, 107, 546, 183; 206/484
See application file for complete search history.

(56) References Cited

U.S. PATENT DOCUMENTS

| | | | | |
|---|---|---|---|---|
| 3,081,911 | A * | 3/1963 | Scholle | 222/107 |
| 3,363,807 | A * | 1/1968 | Powell | 222/105 |
| 3,469,743 | A * | 9/1969 | Becker | 222/105 |
| 6,484,134 | B1 * | 11/2002 | Hoskote | 703/14 |
| 6,540,079 | B1 * | 4/2003 | Garcia et al. | 206/484 |
| 6,651,846 | B2 * | 11/2003 | Duquet et al. | 222/103 |
| 6,655,549 | B2 * | 12/2003 | Duquet et al. | 222/103 |
| 6,705,541 | B2 * | 3/2004 | Schuehrer et al. | 239/34 |
| 6,811,057 | B2 * | 11/2004 | Duquet et al. | 222/105 |
| 6,971,550 | B2 * | 12/2005 | Kuge et al. | 222/105 |
| 7,007,831 | B2 * | 3/2006 | Pennaneac'h et al. | 222/633 |
| 2003/0085298 | A1 | 5/2003 | Schuehrer et al. | |
| 2004/0000561 | A1 * | 1/2004 | Lallemant et al. | 222/92 |

FOREIGN PATENT DOCUMENTS

| | | | |
|---|---|---|---|
| DE | 201 14 352 | U1 | 1/2003 |
| FR | 2 822 808 | A1 | 10/2002 |
| FR | 2 822 809 | A1 | 10/2002 |
| WO | 94/01343 | A1 | 1/1994 |

* cited by examiner

*Primary Examiner* — Kevin P Shaver
*Assistant Examiner* — Daniel R Shearer
(74) *Attorney, Agent, or Firm* — Sughrue Mion, PLLC

(57) ABSTRACT

A fluid dispenser assembly, characterized in that it comprises:

a fluid dispenser (1, 2) comprising a fluid reservoir (1) and a closure member (2), the reservoir comprising at least one flexible sheet (11) provided with an opening (14) cut out in the sheet, the closure member (2) being mounted in said opening (14); and a flexible covering (3) wrapped around the dispenser, the covering including a window (34) through which the closure member (2) can be accessed.

8 Claims, 3 Drawing Sheets

FLUID DISPENSER ASSEMBLY

CROSS REFERENCE TO RELATED APPLICATION

This application claims the benefit under 35 U.S.C. §119 (e) of pending U.S. provisional patent application Ser. No. 60/907,062, filed Mar. 19, 2007, and priority under 35 U.S.C. §119(a)-(d) of French patent application No. FR-07.52603, filed Jan. 10, 2007.

TECHNICAL FIELD

The present invention relates to a fluid dispenser assembly that is more particularly suited to dispensing pastes such as creams, gels, pomades, etc. The present invention finds an advantageous application in the fields of cosmetics, pharmacy, or even perfumery.

BACKGROUND OF THE INVENTION

In the prior art, document FR 2 822 808 is already known that describes a fluid dispenser assembly comprising a dispenser and a wrapper wrapped around the dispenser. The dispenser is in the form of a small, relatively flat pouch defining a dispenser orifice in one of its edges. The dispenser orifice is initially closed by a stopper that is removed, in particular by pulling it off. The wrapper masks the small pouch, but defines a notch where the removable stopper is positioned. To do this, the notch is defined on a lateral edge of the wrapper.

The drawback with that type of dispenser assembly is that the user has difficulty retrieving the fluid that is dispensed by the dispenser. After pulling off the removable stopper, the user presses on the wrapper, thereby flattening the small pouch of the dispenser. Consequently, the fluid is dispensed through the dispenser orifice situated at the bottom of the notch in the wrapper. It can be understood that it is not easy to retrieve the fluid at the bottom of a small notch. Thus, it often happens that the fluid spreads into the wrapper just beside the dispenser orifice. That prior-art dispenser assembly is thus not really adapted to dispensing pastes such as creams. It is more suited to fluids, such a perfume, that are sprayed. No fluid is retrieved directly at the outlet of the dispenser orifice.

BRIEF SUMMARY OF THE INVENTION

An object of the present invention is thus to define a fluid dispenser assembly that is more adapted to dispensing pastes or creams. It should be easy for the user to retrieve the fluid without the fluid spreading everywhere. The assembly should be easy to hold, so as to enable the user to retrieve the fluid easily. The assembly should also be attractive, and should enable information of any kind, such as a trademark, a logo, decoration, or text, to be applied easily and extensively.

To achieve the various objects, the present invention proposes a fluid dispenser assembly, characterized in that it comprises: a fluid dispenser comprising a fluid reservoir and a closure member, the reservoir comprising at least one flexible sheet provided with an opening cut out in the sheet, the closure member being mounted in said opening; and a flexible covering wrapped around the dispenser, the covering including a window through which the closure member can be accessed. Unlike the prior-art dispenser assembly in which the dispenser orifice is situated laterally on an edge, the dispenser orifice of the present invention is situated on the flexible sheet, i.e. away from the edges of the sheet and of the covering. The dispenser orifice is thus situated in a substantially plane surface, thereby favoring retrieval of the dispensed fluid. The opening and the window advantageously define respective peripheral edges that are plane and that are situated one on top of the other in superposed manner. The dispenser is preferably fastened in permanent manner in the covering. However, it is also possible to envisage removing the dispenser from its covering. The closure member advantageously includes permanent or releasable holding means that are suitable for receiving, in stationary manner, the peripheral edge of the window. The holding means preferably comprise an outer peripheral groove in which the edge of the window is received, advantageously by snap-fastening. Thus, it is not even necessary to bond the dispenser inside the covering. However, in some circumstances, alternative or additional adhesive bonding is performed.

In another aspect of the invention, the window is initially closed by a removable cover. The cover is advantageously formed by the covering and is defined by predetermined rupture zones. Before first use, the user removes the removable cover and thus accesses the closure member. Preferably, the removable cover can no longer be repositioned, such that removing the cover informs the user that the assembly is being used for the first time. The removable cover thus fulfils a first-use-guarantee function. In addition, the removable cover attractively finishes off the covering, such that a pattern can extend over the entire covering, including over the cover.

In a practical embodiment, the dispenser includes a front sheet and a rear sheet that are advantageously connected together as a single piece, the sheets being sealed together at their peripheries, the front sheet forming the opening that is advantageously cut out in substantially central manner in the front sheet, the closure member including a peripheral flange to which a peripheral edge of the opening is fastened, advantageously by heat-sealing. In addition, the covering may include a front face and a rear face that are advantageously connected together as a single piece, the front face forming the window that is advantageously cut out in substantially central manner in the front sheet, the dispenser being disposed between the front face and the rear face with the closure member placed at the window. Advantageously, the covering further includes a sealing flap that is advantageously connected as a single piece to the front face, the rear face being fastened to the flap so as to close the covering over the dispenser. The covering thus forms a kind of casing having a face that is pierced with a window. The window may have a wide range of shapes. It may advantageously be centered, or, in contrast, it may be disposed in offset manner. The covering may be made from a single sheet of paper, cardboard, plastics material, metal, or a mixture thereof.

In an advantageous embodiment of the invention, the closure member defines a fluid dispenser orifice that is advantageously disposed in a fluid-retrieval dish, and includes a repositionable closure cap that is suitable for closing the orifice and advantageously for covering the retrieval dish. Thus, each time fluid is dispensed, the user may retrieve it in the retrieval dish, then close the dispenser orifice by closing the closure cap.

The dispenser assembly may advantageously present a substantially-flat general configuration defining a plane, the dispenser orifice extending along an axis that is substantially perpendicular to said plane.

A principle of the invention is to cover, in attractive and functional manner, a dispenser having a fluid outlet that is situated in a substantially plane sheet. The orifice is not situated between two sheets, but, in contrast, is situated in a single sheet that is cut in such a manner as to form an opening that does not extend as far as the edge of the sheet. Consequently, the opening is bordered by a line of sealing, making it possible to fasten the sheet provided with the opening to another element, such as another sheet.

BRIEF DESCRIPTION OF THE DRAWINGS

The invention is described more fully below with reference to the accompanying drawings which show two embodiments of the invention by way of non-limiting example.

In the figures.

DETAILED DESCRIPTION

Figure 2:
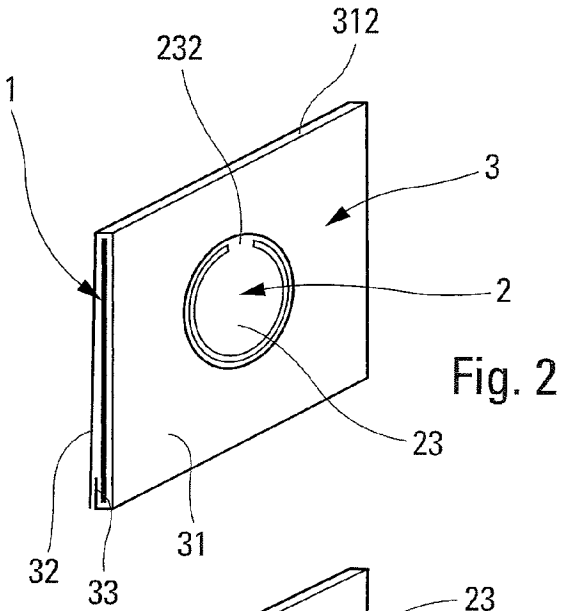
FIG. 2 is a view of the FIG. 1 dispenser assembly in its assembled state.
Figure 3:
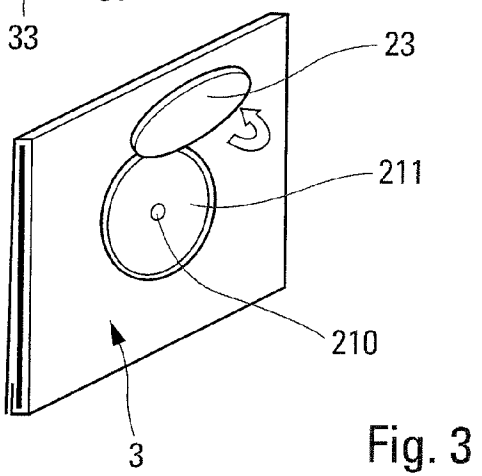
FIG. 3 is a view similar to FIG. 2 with the dispenser in the open position.
Figure 1:
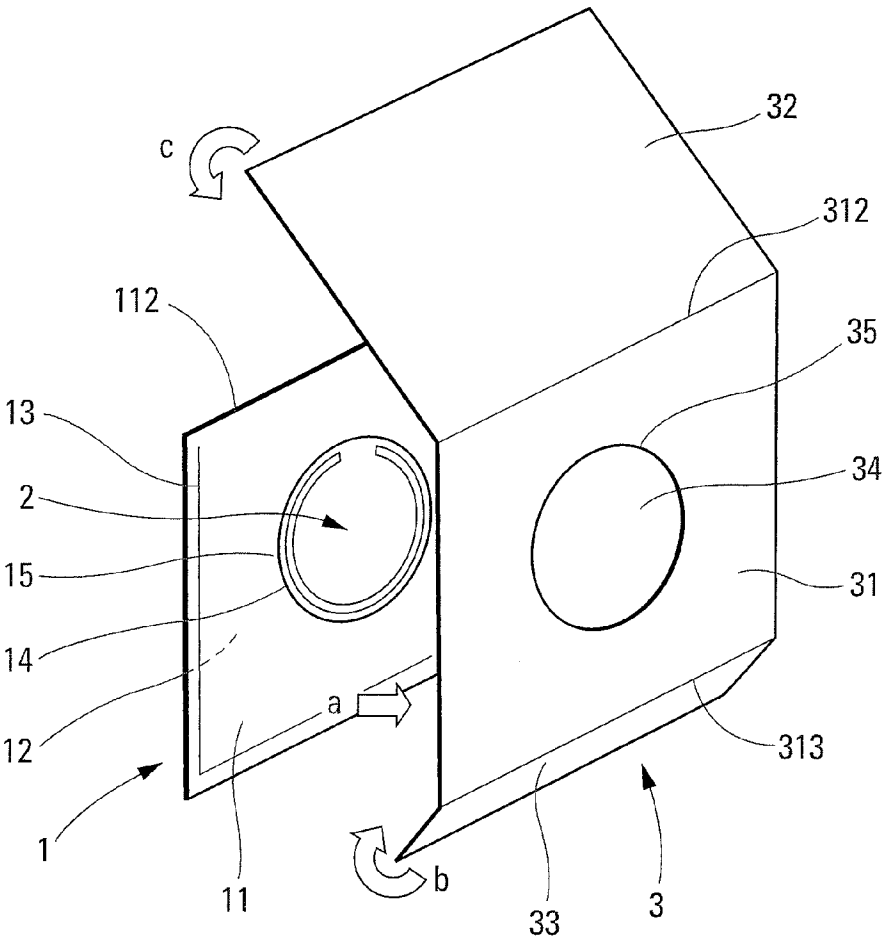
FIG. 1 is an exploded perspective view of a fluid dispenser assembly constituting a first embodiment of the invention in the process of being assembled.

Reference is made firstly to FIGS. 1 to 3 to describe in detail the first embodiment of a fluid dispenser assembly of the invention. The assembly comprises three component elements, namely a fluid reservoir 1, a closure member 2, and a covering 3. The reservoir 1 and the closure member 2 are assembled together to constitute a fluid dispenser.

The reservoir 1 is made of flexible material, e.g. such as sheets constituted by a laminate of aluminum and plastics material. It is also possible to use sheets made only of plastics material, paper, metal, etc. The reservoir is in the form of a small flat pouch comprising a front sheet 11 and a rear sheet 12 that can advantageously be made as a single piece, i.e. with a common edge 112. It is also possible to make the reservoir from two separate sheets 11 and 12. The sheets 11 and 12 are disposed in superposed manner and are sealed at their periphery 13. Sealing can advantageously be performed by heat-sealing. It is thus advantageous to use sheets made of plastics material or with a plastics-material coating. Sealing can be performed over the entire periphery of the sheets, including at the common edge 112. In practice, sealing is performed on three sides, with the side formed by the common edge 112 not being sealed. In an advantageous characteristic of the invention, the front sheet 11 is formed with an opening 14 defining a peripheral edge 15. In this embodiment, the opening 14 is formed substantially at the center of the sheet 11. It is also possible to position the opening 14 in off-centered manner, but always away from the outer edges of the sheet 11. In other words, the opening 14 is completely surrounded by a peripheral edge 15 formed by the sheet 11. The opening 14 therefore lies in the plane of the sheet 11, as does the peripheral edge 15.

Figure 7:
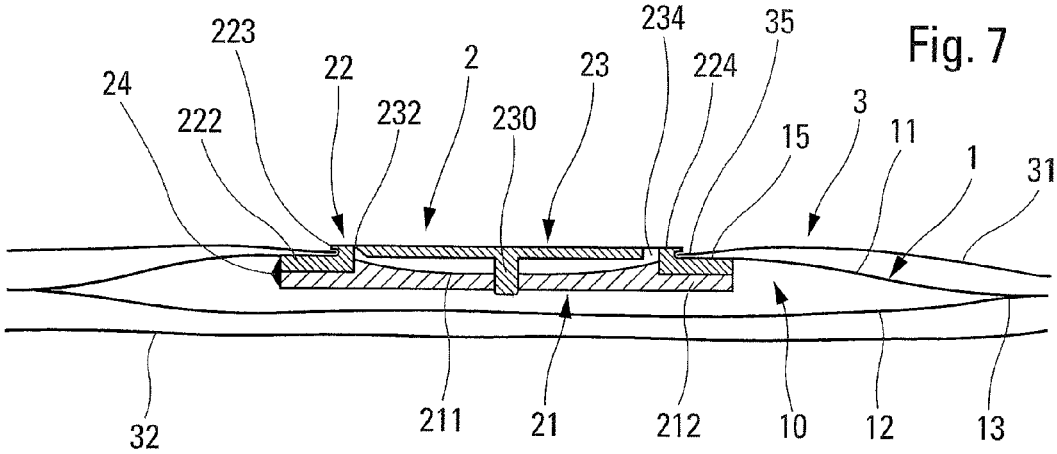
FIG. 7 is a larger-scale cross-section view through the dispenser assembly in FIGS. 1 to 3 in the closed state.
Figure 8:
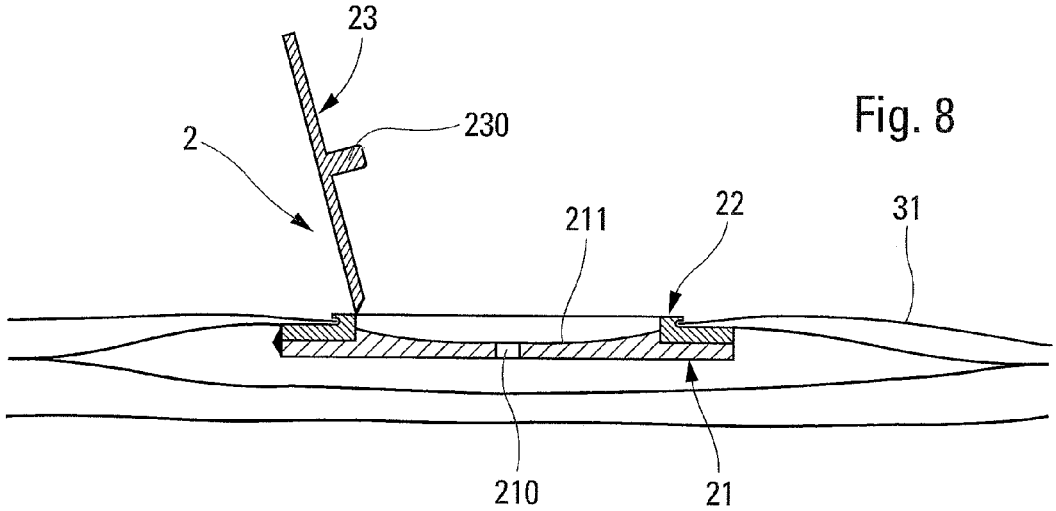
FIG. 8 is a view similar to FIG. 7 with the dispenser in the open position.
Figure 9:
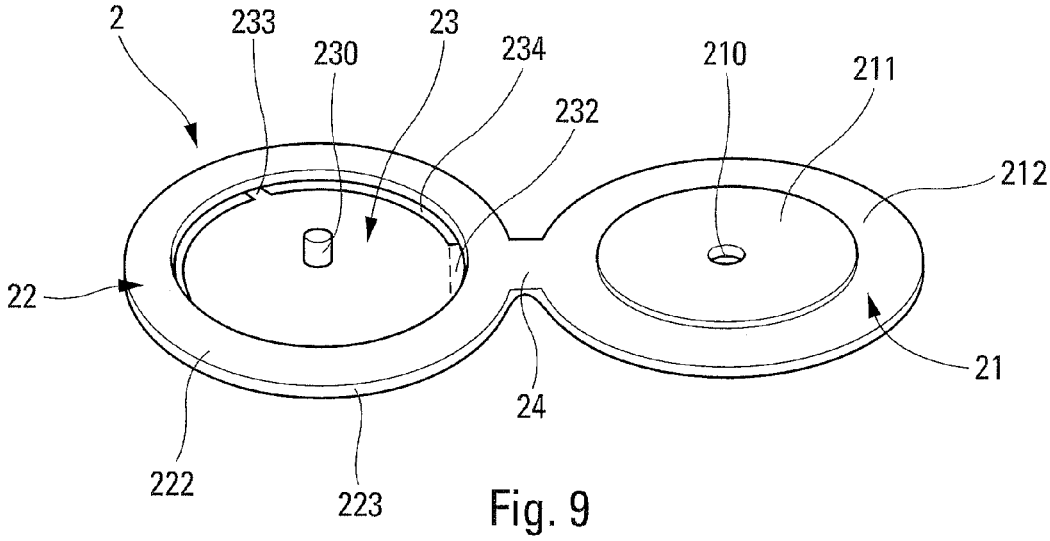
FIG. 9 is a perspective view of the closure member used in the first embodiment of the invention, in its state on leaving the mold.

The closure member 2 is positioned at the opening 14 of the sheet 11, in such a manner as to close the opening 14. A function of the closure member 2 is to enable the fluid that is stored inside the reservoir 1 to be expelled. To do this, the closure member defines a fluid dispenser orifice 210 that puts the inside of the reservoir into communication with the outside. The closure member advantageously includes a stopper element for closing the dispenser orifice in leaktight manner. Reference is made below to FIGS. 7, 8, and 9 in order to describe in detail a non-limiting embodiment of a closure member of the invention. The closure member comprises three parts, even if they can be made as a single piece. Thus, the closure member includes a bottom 21 defining a retrieval dish 211, the dispenser orifice 210, and a peripheral border 212. The retrieval dish 211 presents a configuration that is preferably concave. The dispenser orifice 210 is positioned at the center of the dish 211. The peripheral border 212 surrounds the retrieval dish 211. The outer peripheral edge of the dish 211 projects beyond the border 212. The second part of the closure member is a crown 22 that is advantageously connected to the bottom 21 via a bridge of material 24. The crown forms an annular fastener zone 222 that surrounds a projecting annular rim 224. The rim defines an annular peripheral groove 223 that serves as holding means for holding the covering 3, as can be seen below. The crown 22 is disposed on the border 212 in such a manner as to surround the retrieval dish 211. This can be seen in FIGS. 7 and 8. However, on leaving the mold, as shown in FIG. 9, the crown 22 is positioned in the same plane as the bottom 21. It is thus possible to engage the crown 22 on the bottom 21 by pivoting, deforming the bridge of material 24. The annular peripheral fastener zone 222 extends around the groove 223. The fastener zone 222 serves to fasten the sheet 11 of the reservoir. More precisely, as can be seen in FIGS. 7 and 8, the edge 15 of the opening 14 is sealed, advantageously by heat-sealing, on the fastener zone 222 of the crown 22. Sealing is performed over the entire periphery of the crown, in such a manner as to form a leaktight contact. The third part of the closure member is a repositionable closure cap 23 that defines a closure pin 230 for being engaged, in leaktight manner, in the dispenser orifice 210 of the bottom 21. The cap also covers the retrieval dish 211. the cap 23 is connected to the crown by a hinge 232. Initially, as shown in FIG. 9, the cap 23 extends substantially in the same plane as the crown 22, and it is connected to said crown by a plurality of breakable bridges of material 233. Alternatively, the outer edge of the cap is separated from the crown by arcuate slots 234. Before first use, the breakable bridges of material 233 are intact. This informs the user that the closure member has never been opened. The bridges 233 thus perform a first-use-guarantee function. The crown 22 is fastened in permanent manner on the border 212 of the bottom 21, e.g. by heat-sealing. It should be observed that only the sheet 11 is fastened on the closure member 2. The rear sheet 12 has no fastening point with the closure member 2. However, this is not excluded.

Naturally, instead of the particular closure member of FIGS. 7 to 9, it is possible to use any appropriate closure member that enables fluid to be expelled from a reservoir formed by one or two flexible sheets. The repositionable closure cap is even optional.

The covering 3 comprises a front face 31 and a rear face 32, the two faces possibly being made as a single piece, being joined via a common edge 312. The front face 31 is formed with a window 34 defining a peripheral edge 35. In the example shown, the window 34 is situated substantially at the center of the front face 31. In addition, the covering also comprises a sealing flap 33 that, in this embodiment, is connected to the front face 31. The flap 33 can be formed as a single piece with the front face 31, defining a common edge 313 that is advantageously parallel to the edge 312 connecting the front face to the rear face. The first assembly step a consists in fitting the dispenser 1 against the front face 31, in such a manner as to place the closure member 2 in the window 34. The edge of the window can advantageously be snap-fastened in the groove 223 of the closure member. The sheet 11 of the reservoir can also be bonded to the inside of the front face 31. The second assembly operation consists in folding the flap 33 onto the dispenser 1, in such a manner as to press it against the rear sheet 12. The third operation consists in folding the rear face 32 onto the dispenser 1, such that the rear face 32 presses against the rear sheet 12. The rear sheet 12 can be bonded to the rear face 32. Finally, the rear face 32 is fastened to the flap 33, advantageously by adhesive or by heat-sealing. The dispenser 1 is thus wrapped completely in the covering 3. This is shown in FIG. 2. However, it is possible to see the dispenser 1 via the open sides of the covering 3. However, it is not excluded to form the covering 3 with lateral flaps (not shown), making it possible to close the covering 3 completely over the dispenser 1, such that said dispenser can no longer be seen at all, except at its closure member 2.

It thus suffices for the user to lift up the cap 23 by breaking the bridges of material 233 in order to uncover the dispenser orifice 210 and its retrieval dish 211. By pressing the covering 3 in such a manner as to bring the front face towards the rear face, the reservoir 1 is deformed and the fluid that it contains is put under pressure, such that it is forced to flow through the dispenser orifice 211. The user can thus retrieve the fluid that has accumulated in the retrieval dish 211. After use, the user can close the cap 23, in such a manner as to close the orifice 210. With reference once again to FIGS. 7 and 8, it can be seen that the peripheral edge 35 of the window 34 extends over the crown 22 of the closure member 2. The peripheral edge 35 is advantageously inserted in the groove 223 formed by the crown 22. However, it is not excluded to fasten the edge 35 on the crown, e.g. by adhesive or heat-sealing. The edge 35 can be held in the groove 223 by snap-fastening. In the absence of a groove 223, the dispenser 1 can be held inside the covering 3 by any means, e.g. by adhesive. The edge 35 can come to be housed around the rim 224 on the zone 222. This makes it possible to center the dispenser, and more particularly its closure member relative to the window 34.

The covering 3 is made of a flexible material, e.g. such as paper, cardboard, plastics material, or metal. Once wrapped around the dispenser 1, the front face 31, and advantageously the rear face 32, present a certain flexibility, making it possible for them to deform in such a manner as to move towards and away from each other.

Figure 5:
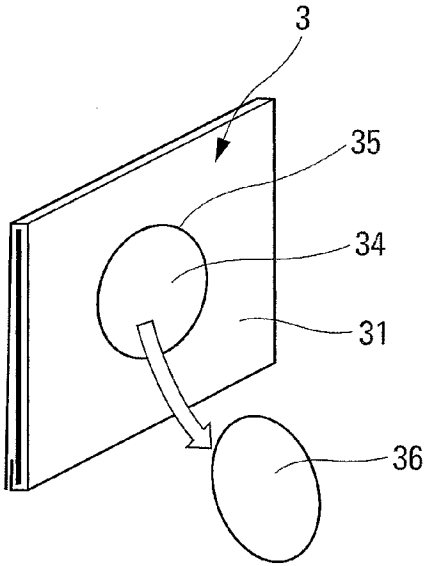
FIG. 5 is a view of the FIG. 4 dispenser assembly in its assembled state, after the removable cover has been removed.
Figure 6:
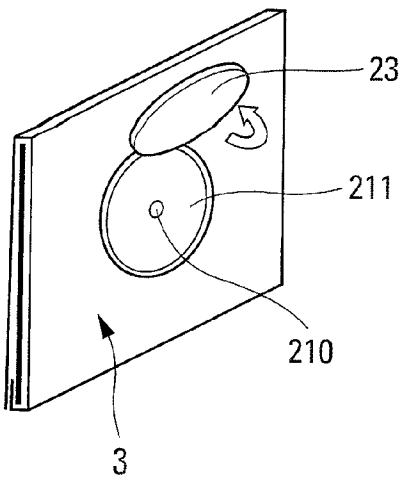
FIG. 6 is a view similar to FIG. 3 for the second embodiment of the invention.
Figure 4:
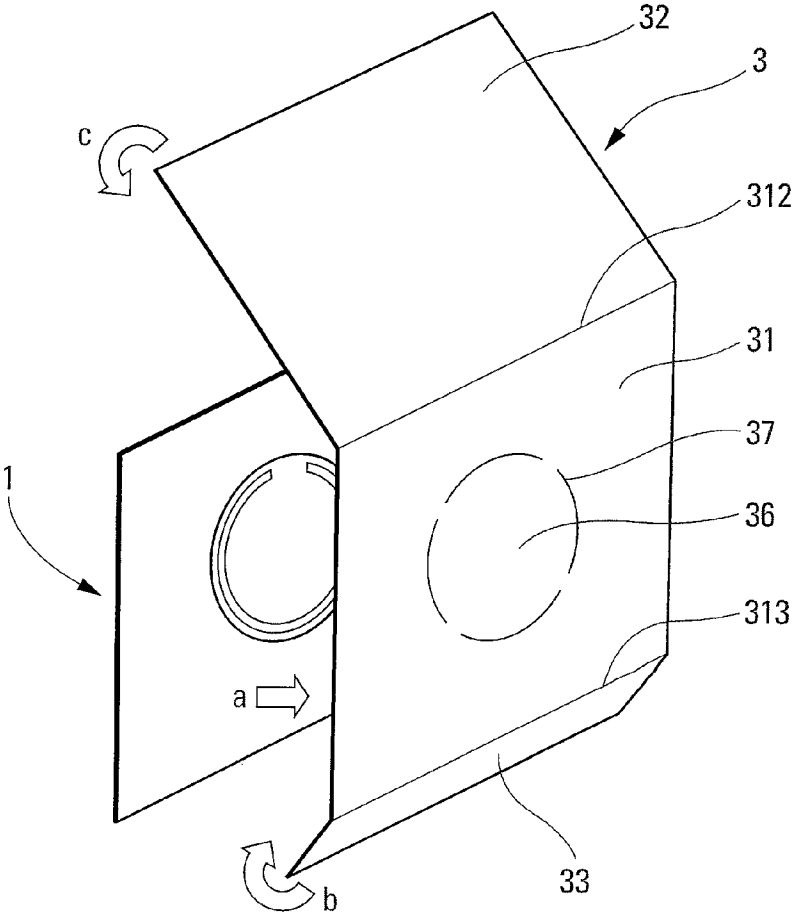
FIG. 4 is a view similar to FIG. 1 for a second embodiment of the invention.

Reference is made below to FIGS. 4 to 6 which show a second embodiment that constitutes a variant of the first. The dispenser 1 can be substantially or completely identical to the dispenser of the first embodiment. The covering 3 differs from the covering of the first embodiment in that the window 34 is initially closed by a cover 36 that is advantageously formed integrally with the front face 31. The cover 36 is defined by predetermined rupture zones 37 that can be perforations or zones of weakness. To uncover the window, as shown in FIG. 5, it suffices for the user to pull on the removable cover 36, so as to separate it from the sheet 31 at the predetermined rupture zones 37. Then, the user can use the assembly as in the first embodiment. The removable cover 36 makes it possible to preserve the integrity of the front face 31, such that it can be decorated without interruption at the window. It is possible to emboss the cover 36 in such a manner that it is in relief relative to the remainder of the front face 31. In this way, the cover 36 can be positioned on the cap 23 and the rim 224 of the closure member, with the edge 35 of the window being received in the groove 223 or at least around the rim 224.

The invention thus provides a fluid dispenser assembly that can be used like a conventional pot, with the retrieval dish 211 being held horizontally. The user holds the assembly in one hand and presses on the front face 31 so as to expel the fluid. The user can thus retrieve the fluid with the other hand. After use, the user can close the cap, guaranteeing perfect sealing. Naturally, the covering 3 makes it possible to improve the appearance of the dispenser 1, but it also makes it easier to hold the assembly in the hand, and significantly increases the surface area are for applying information, e.g. such as decoration, a logo, a trademark, or any other legal or useful information. The dispenser assembly presents thickness that is small, of the order of a few millimeters. It is relatively flat, in such a manner as to occupy a plane. This makes it possible to insert it in magazines as a publicity sample. However, it should be observed that the dispenser orifice 210 extends perpendicularly to the plane of the assembly.

The invention claimed is:

1. A fluid dispenser assembly, comprising:

a fluid dispenser (1, 2) comprising a fluid reservoir (1) and a closure member (2), the reservoir comprising at least one flexible sheet (11) provided with an opening (14) cut out in the sheet, the closure member (2) defining a fluid dispenser orifice (210), the closure member being mounted in said opening (14); and a flexible covering (3) wrapped around the dispenser, the covering including a window (34) through which the closure member (2) can be accessed, wherein the opening (14) and the window (34) define respective peripheral edges (15, 35) that are planar and superposed with each other, wherein the closure member (2) includes holding means (223) that are suitable for receiving, in stationary manner, the peripheral edge (35) of the window (34), and wherein the holding means comprise an outer peripheral groove (223) in which the edge (35) of the window (34) is received by snap fastening, wherein the fluid dispenser is in a substantially flat general configuration defining a plane, and the dispenser orifice (210) extends along an axis that is substantially perpendicular to said plane, and wherein the closure member (2) defines a fluid dispenser orifice (210) that is disposed in a fluid-retrieval dish (211), and includes a repositionable closure cap (23) that is suitable for opening and closing the orifice (210) and for covering the retrieval dish (211).

2. A dispenser assembly according to claim 1, in which the dispenser (1, 2) is fastened in permanent manner in the covering, the fluid being dispensed through the window of the covering after the closure member has been opened.

3. A dispenser assembly according to claim 1, in which the window (34) is initially closed by a removable cover (36).

4. A dispenser assembly according to claim 3, in which the cover (36) is formed by the covering (3) and is defined by predetermined rupture zones (37).

5. A dispenser assembly according to claim 1, in which the dispenser (1, 2) includes a front sheet (11) and a rear sheet (12) that are connected together as a single piece having a common edge, the sheets being sealed together at their peripheries (13), the front sheet (11) forming the opening (14), the closure member (2) including a peripheral flange (223) to which a peripheral edge (15) of the opening (14) is fastened by heat-sealing.

6. A dispenser assembly according to claim 1, in which the covering includes a front face (31) and a rear face (32) that are connected together as a single piece having a common edge, the front face (31) forming the window (34) that is cut out in substantially central manner in the front sheet, the dispenser (1, 2) being disposed between the front face (31) and the rear face (32) with the closure member (2) placed at the window (34).

7. A dispenser assembly according to claim 6, in which the covering further includes a sealing flap (33) that is connected as a single piece to the front face (31), the rear face (32) being fastened to the flap (33) so as to close the covering over the dispenser.

8. A dispenser assembly comprising:

a fluid reservoir (1) for containing fluid therein, formed as a flat pouch shape comprising a front sheet and a rear sheet superimposed with each other and sealed together along their entire peripheries, wherein the front sheet includes an opening defined by a peripheral edge;

a closure member (2) positioned at the opening of the front sheet, for enabling the fluid stored inside the reservoir to be expelled therefrom, wherein the closure member includes a fastener zone having a projecting annular rim, an orifice and a repositionable closure cap; and a flexible covering (3) comprising a front face and a rear face, wherein the front face includes an opening defined by a peripheral edge, wherein the closure member is disposed in the window of the front face, and wherein the fluid reservoir is disposed between the front face and the rear face so that the fluid reservoir is substantially wrapped by the covering, wherein the front sheet of the fluid reservoir is bonded to the front face of the flexible covering, and wherein the peripheral edges of the opening of the front sheet and peripheral edges of the opening of the front face are superimposed together, and attached to the projecting annular rim, by snap fastening in an outer peripheral groove adjacent to the projecting annular rim, in a leaktight manner, wherein the closure member (2) defines a fluid dispenser orifice (210) that is disposed in a fluid retrieval dish (211) for accumulating fluid that has flowed out of the reservoir via the fluid dispenser orifice and for facilitating retrieval of the accumulated fluid by a user, and wherein the fluid closure member (2) includes a repositionable closure cap (23) that is suitable for opening and closing the orifice (210) and for covering the fluid retrieval dish (211).

* * * * *